US007866664B2

(12) United States Patent
Kao

(10) Patent No.: US 7,866,664 B2
(45) **Date of Patent: *Jan. 11, 2011**

(54) METHOD FOR SENSING PAPER SKEW AND METHOD FOR CORRECTING PAPER SKEW

(75) Inventor: Tsung-Fu Kao, Taipei (TW)

(73) Assignee: Kinpo Electronics, Inc., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/713,984

(22) Filed: Feb. 26, 2010

(65) Prior Publication Data

US 2010/0148429 A1 Jun. 17, 2010

Related U.S. Application Data

(62) Division of application No. 12/050,998, filed on Mar. 19, 2008, now Pat. No. 7,703,766.

(30) Foreign Application Priority Data

Dec. 5, 2007 (TW) ..... 96146222 A

(51) Int. Cl.
*B65H 7/02* (2006.01)

(52) U.S. Cl. ..... 271/227; 271/259; 271/261; 271/265.02; 271/265.03; 399/394; 399/395

(58) Field of Classification Search ..... 271/227
See application file for complete search history.

(56) References Cited

U.S. PATENT DOCUMENTS

| | | | | |
|---|---|---|---|---|
| 4,738,442 | A * | 4/1988 | Rodi et al. | 271/261 |
| 6,895,210 | B1 | 5/2005 | Quesnel | |
| 7,086,714 | B2 * | 8/2006 | Endo | 347/16 |
| 2006/0163801 | A1 * | 7/2006 | Dejong et al. | 271/227 |
| 2007/0040326 | A1 * | 2/2007 | Noda et al. | 271/227 |
| 2008/0240820 | A1 * | 10/2008 | deJong et al. | 399/395 |
| 2008/0296835 | A1 * | 12/2008 | Dejong et al. | 271/227 |
| 2009/0033028 | A1 * | 2/2009 | Yahata et al. | 271/259 |

FOREIGN PATENT DOCUMENTS

| | | | |
|---|---|---|---|
| JP | 5-116811 | | 5/1993 |
| JP | 05116811 | A * | 5/1993 |

* cited by examiner

*Primary Examiner*—Stefanos Karmis
*Assistant Examiner*—Prasad V Gokhale
(74) *Attorney, Agent, or Firm*—Muncy, Geissler, Olds & Lowe, PLLC

(57) ABSTRACT

A method for sensing a paper skew adapted for a device having a paper feeding mechanism is provided. The device has a feed sensor which is fixed at a start position of paper feeding; and, a position sensor which moves in a direction perpendicular to a direction of paper feeding and passes through a first and a second positions. The first position is the intersection of a moving path of the position sensor and a line. The feed sensor is on the line, and the line is parallel to the direction of paper feeding. The method includes the device having a first distance; moving the position sensor to the second position; feeding a work paper into the device; obtaining a second distance which is a moving distance of the work paper fed; and determining whether the work paper is skewed or not according to the difference between the first and the second distances.

14 Claims, 5 Drawing Sheets

METHOD FOR SENSING PAPER SKEW AND METHOD FOR CORRECTING PAPER SKEW

CROSS REFERENCE TO RELATED APPLICATIONS

This Non-provisional application is a Divisional Application claiming the benefit of U.S. Non-provisional application Ser. No. 12/050,998 filed on Mar. 19, 2008 now U.S. Pat. No. 7,703,766 and entitled "Method for sensing paper skew and method for correcting paper skew", the entire disclosure of which is hereby incorporated herein by reference for all purposes.

BACKGROUND OF THE INVENTION

1. Field of Invention

The present invention relates to a method for sensing a paper skew, and more particularly to a method for sensing a paper skew by employing existing sensors of a device having a paper feeding mechanism, in which the sensing result further is utilized for correcting the paper skew.

2. Related Art

Nowadays a device (such as a printer, copier or scanner) generally has a paper feeding mechanism for feeding a paper into the device and then printing or scanning. However, any paper feeding mechanism has a problem of paper skew while feeding. As a result, the contents printed on the paper or scanned from the paper are skewed, and even need to print or scan again. It may waste resources. Therefore, various mechanisms for sensing and correcting the paper skew have been developed.

Referring to FIG. 1, there is shown a sketch diagram illustrating the position relationship of a paper and sensors in accordance with a conventional method for sensing and correcting the paper skew disclosed by U.S. Pat. No. 6,895,210. In FIG. 1, the direction of y is a direction of feeding a paper 10 (which is called the direction of paper feeding thereinafter), and the direction of x is perpendicular to the direction of y. In the conventional method, both sensors 11 and 12 are configured on a line parallel to the direction of x, and both the sensor 12 and a sensor 13 are configured on another line parallel to the direction of y. The sensor 11 and 12 are used to measure skew, and the sensors 12 and 13 are used to measure velocity. After the paper 10 is fed, because of the paper skew, the paper 10 will be sensed by the sensor 11 at time t1, and then sensed by the sensor 12 at time t2, and finally sensed by the sensor 13 at time t3. Therefore, a skew angle θ of the paper 10 is $\tan^{-1}[d2/d1*(t2-t1)/(t3-t2)]$ in radian, where d1 is the distance between the sensors 11 and 12, and d2 is the distance between the sensors 12 and 13.

The measured skew angle θ of the paper 10 can be employed by the printer, copier or scanner to modulate the angle of the paper 10 for compensating the paper skew in the hardware manner, or to modulate the contents to be printed on the paper 10 or scanned from the paper 10 for compensating the paper skew in the software manner. However, the method for sensing and correcting the paper skew disclosed by the patent additionally needs three sensors for sensing the paper 10 and a timer for measuring the time t1-t3.

SUMMARY OF THE INVENTION

The present invention is directed to provide a method for sensing a paper skew by employing existing sensors of a device (such as a printer, copier or scanner) having a paper feeding mechanism, in which the sensing result further is utilized for correcting the paper skew.

In accordance with the present invention, a method for sensing a paper skew adapted for a device having a paper feeding mechanism is provided. The device has a feed sensor and a position sensor. The feed sensor is fixed at a start position of paper feeding. The position sensor moves in a direction perpendicular to a direction of paper feeding and passes through a first position and a second position. The first position is the intersection of a moving path of the position sensor and a line, in which the feed sensor is on the line, and the line is parallel to the direction of paper feeding. In the method for sensing the paper skew, a first distance is preset in the device or obtained by feeding a measure paper to measure if necessary, in which the first distance is a moving distance of the measure paper fed, starting when the measure paper is sensed by the feed sensor and ending when the measure paper is sensed by the position sensor at the first position. Next, the position sensor at the first position is moved to the second position. A work paper is then fed into the device, and subsequently a second distance is obtained, in which the second distance is a moving distance of the work paper fed, starting when the work paper is sensed by the feed sensor and ending when the work paper is sensed by the position sensor at the second position. Finally, it is determined whether the work paper is skewed or not according to the difference between the first distance and the second distance. If the difference is zero, the work paper is not skewed; otherwise, if the difference is not zero, the work paper is skewed.

In accordance with the present invention, a method for correcting a paper skew adapted for the above-mentioned device is provided. In the method for correcting the paper skew, it first determines the first distance and the second distance for the work paper's skew type and skew angle by utilizing the above-mentioned method for sensing the paper skew. If the difference between the first distance and the second distance doesn't exceed a threshold value, the work paper is kept on feeding to be processed by the device; otherwise, if the difference exceeds the threshold value, contents to be printed on or scanned from the work paper are modulated for compensating the paper skew, and then the work paper is kept on feeding to be processed by the device.

The present invention employs the existing feed and position sensors of the device (such as a printer, copier or scanner) having the paper feeding mechanism for sensing the paper skew, and further utilizes the sensing result for correcting the paper skew or directly rejecting the paper. It is because that the device having the paper feeding mechanism generally configures sensors (such as the feed sensor of the present invention) for sensing the paper feeding condition (such as paper jam or out-of-paper), and the print head or image sensor of the device generally configures a position sensor for positioning the print head or image sensor while it shuttlecocks to print or scan.

BRIEF DESCRIPTION OF THE DRAWINGS

The foregoing and other features of the disclosure will be apparent and easily understood from a further reading of the specification, claims and by reference to the accompanying drawings in which like reference numbers refer to like elements and wherein:

DETAILED DESCRIPTION OF THE INVENTION

In accordance with the present invention, a method for sensing a paper skew adapted for a device having a paper feeding mechanism is provided, in which the device may be a printer, copier or scanner, and the device has a fixed feed sensor and a moveable position sensor. For convenience, we take an inkjet printer for example thereinafter.

Figure 1:
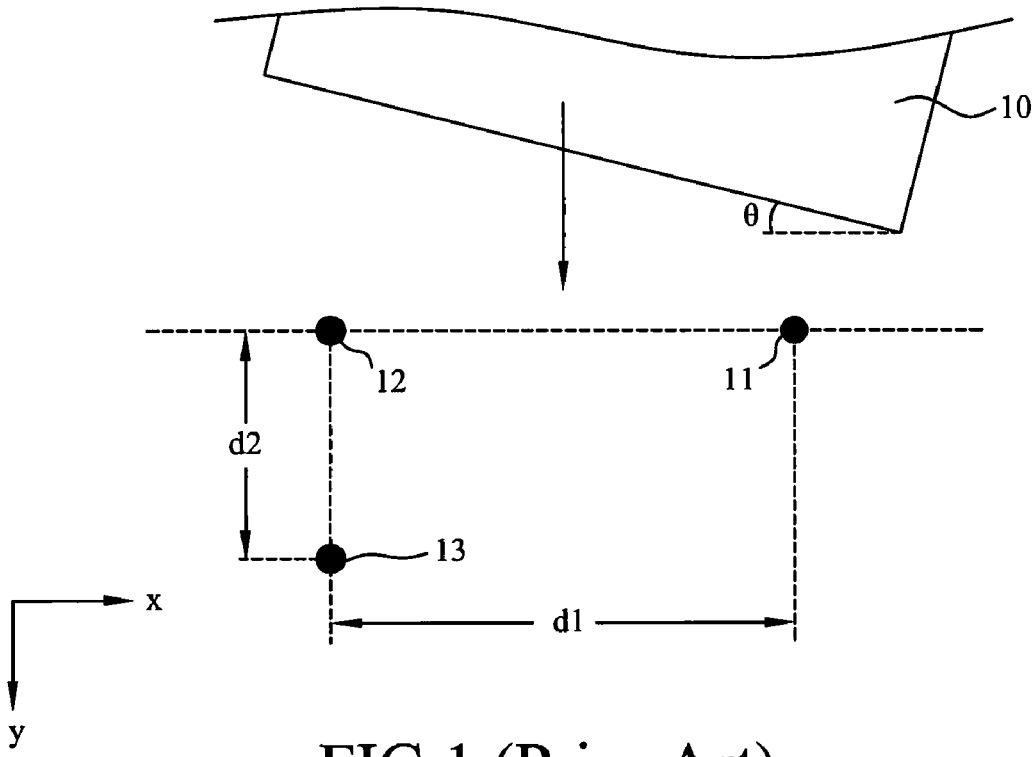
FIG.1 (Prior Art)
FIG. 1 is a sketch diagram illustrating the position relationship of a paper and sensors in accordance with a conventional method for sensing and correcting a skew paper.
Figure 2:
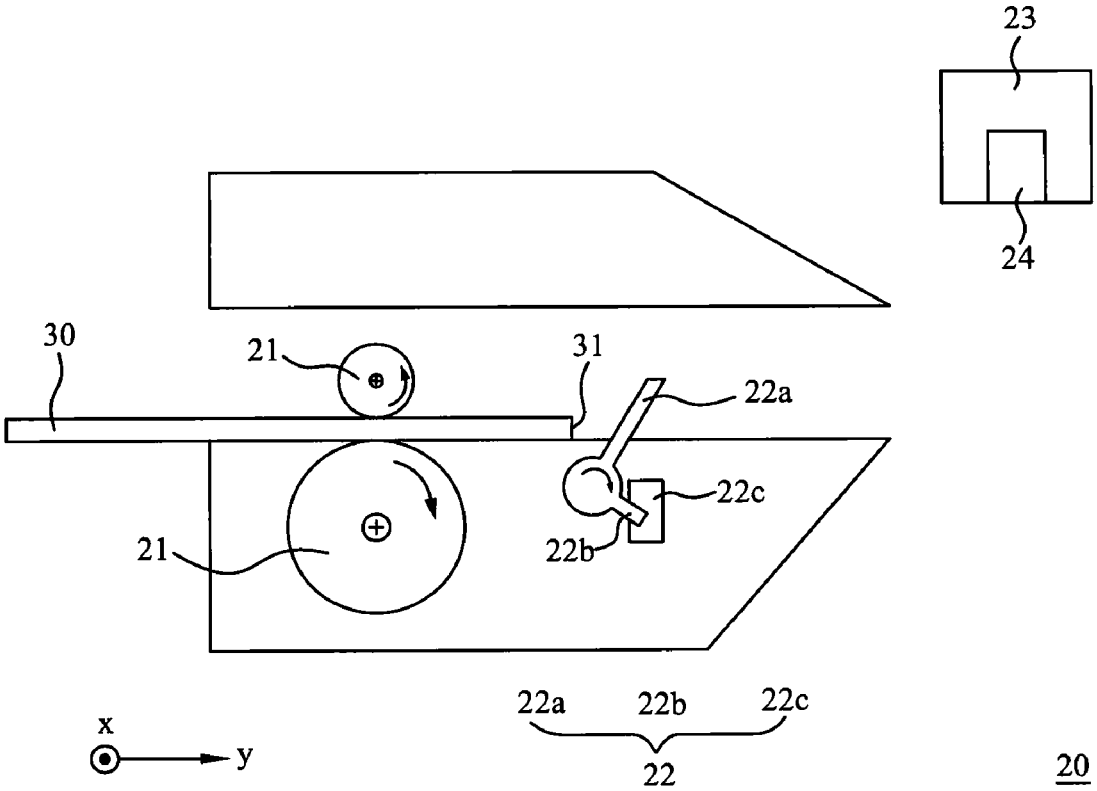
FIG. 2 is a sketch diagram illustrating the side view of a paper feeding mechanism and a print head of an inkjet printer in accordance with one embodiment of the present invention.

FIG. 2 is a sketch diagram illustrating the side view of a paper feeding mechanism and a print head of an inkjet printer in accordance with one embodiment of the present invention; and FIGS. 4A-4D are sketch diagrams illustrating the planar relative position relationship of a paper, a feed sensor and a position sensor of the printer shown in FIG. 2. Referring now to FIGS. 2 and 4A-4D, as defined in FIG. 1, the direction of y is the direction of feeding a measure paper 30' or work paper 30 (which is called the direction of paper feeding thereinafter), and the direction of x is perpendicular to the direction of y. It is mentioned that a position sensor 24 moves in the direction of x thereinafter. In the paper feeding mechanism of the inkjet printer 20, rollers 21 are driven by a motor (not shown) for pushing the measure paper 30' or work paper 30 to move in the direction of paper feeding. In one embodiment, the motor is a stepping motor which can provide accurate positioning. In an alternative embodiment, the motor is a DC motor which can cooperate with an encoder or rotary sensor to provide accurate positioning. No matter what kind of motor it employs, the motor needs be controlled by a specific driver (not shown) for monitoring velocity and position information.

The printer 20 has a fixed feed sensor 22 and a movable position sensor 24. The feed sensor 22 is fixed at a start position I of paper feeding, and used for sensing whether paper feeding starts or not. The position sensor 24 moves in the direction (i.e. the direction of x) perpendicular to the direction of paper feeding (i.e. the direction of y). When the measure paper 30' or work paper 30 is pushed forward until the head 31' of the measure paper 30' or the head 31 of the work paper 30 is sensed by the feed sensor 22, the feed sensor 22 sends a signal to a controller (not shown) of the printer 20, so that the controller obtains a value from the driver of the motor. Subsequently, the paper 30' or 30 is kept on feeding and pushed forward until its head 31' or 31 is sensed by the position sensor 24, the position sensor 24 sends another signal to the controller of the printer 20, so that the controller obtains another value from the driver of the motor. Finally, the controller calculates the difference between the two values obtained early and late, in which the difference is a moving distance of the paper 30' or 30 fed, starting when the paper 30' or 30 is sensed by the feed sensor 22 and ending when the paper 30' or 30 is sensed by the position sensor 24. Similarly, when the position sensor 24 is driven to move from a position to another position by a motor, the controller of the printer 20 also can calculate the difference between two values obtained early and late from the driver of the motor, in which the difference is a moving distance of the position sensor 24.

In the embodiment, the feed sensor 22 has an L-shaped lever with two lever 22*a* and 22*b*, and a photo interrupter 22*c*. When the paper 30' or 30 is pushed to contact the lever 22*a*, the L-shaped lever is forced to rotate clockwise, so that the lever 22*b* interrupts the light of the photo interrupter 22*c* and the photo interrupter 22*c* sends a signal to represent the entrance of a paper. In addition, the printer head 23 of the printer 20 generally configures a position sensor 24 for positioning the print head 23 while it shuttlecocks to print contents on the work paper 30. Therefore, in the embodiment, before printing, it employs the existing position sensor 24 of the print head 23 and the existing feed sensor 22 to determine whether the skew of the work paper 30 is tolerable or not. If the skew of the work paper 30 is tolerable, the position sensor 24 is now used for positioning the print head 23 while it shuttlecocks to print contents on the work paper 30

Figure 3A:
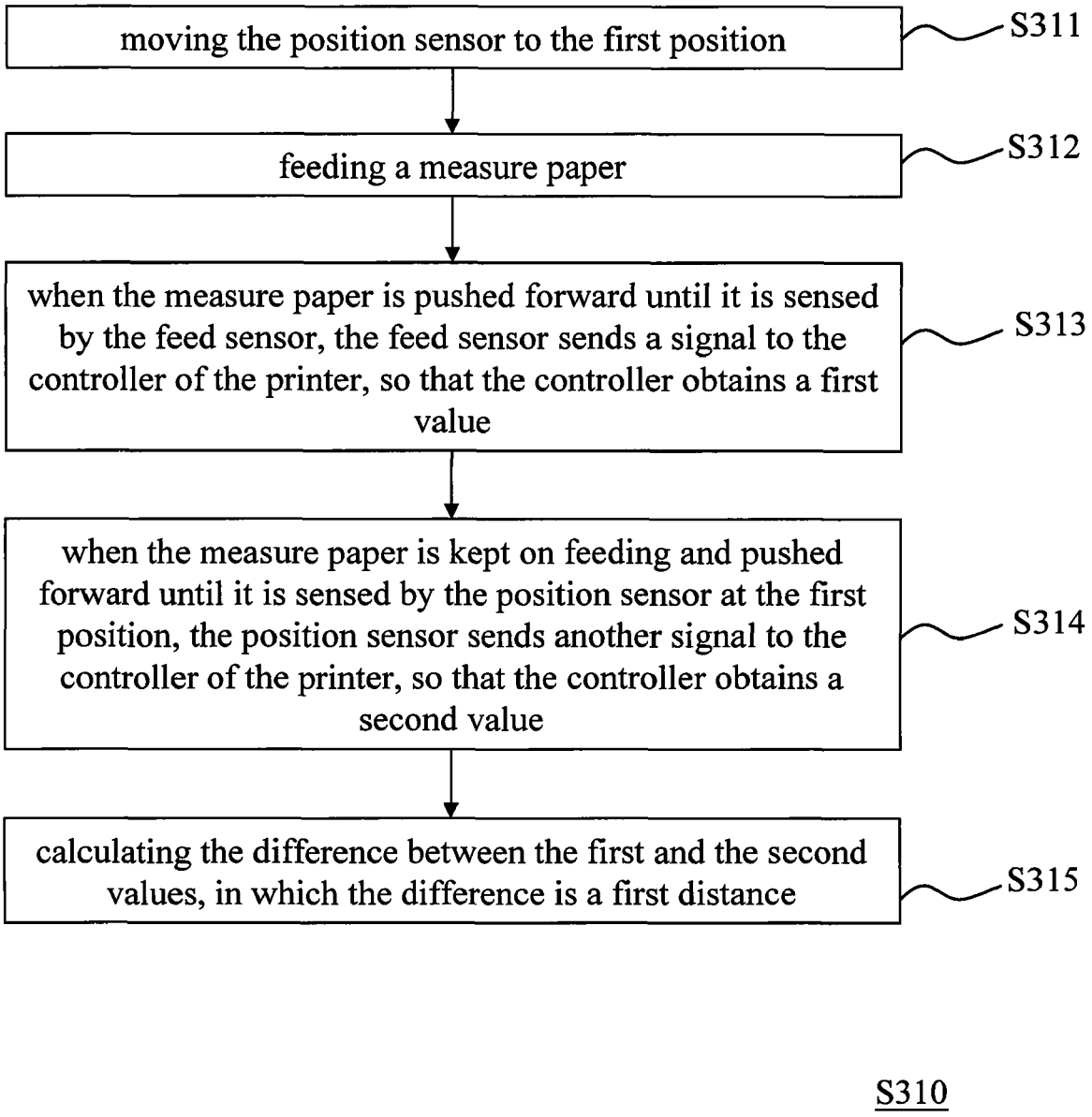
FIGS. 3A and 3B are a flowchart illustrating a method for sensing and correcting a skew paper in accordance with one embodiment of the present invention, in which the method is adapted for the printer shown in FIG. 2.
Figure 3B:
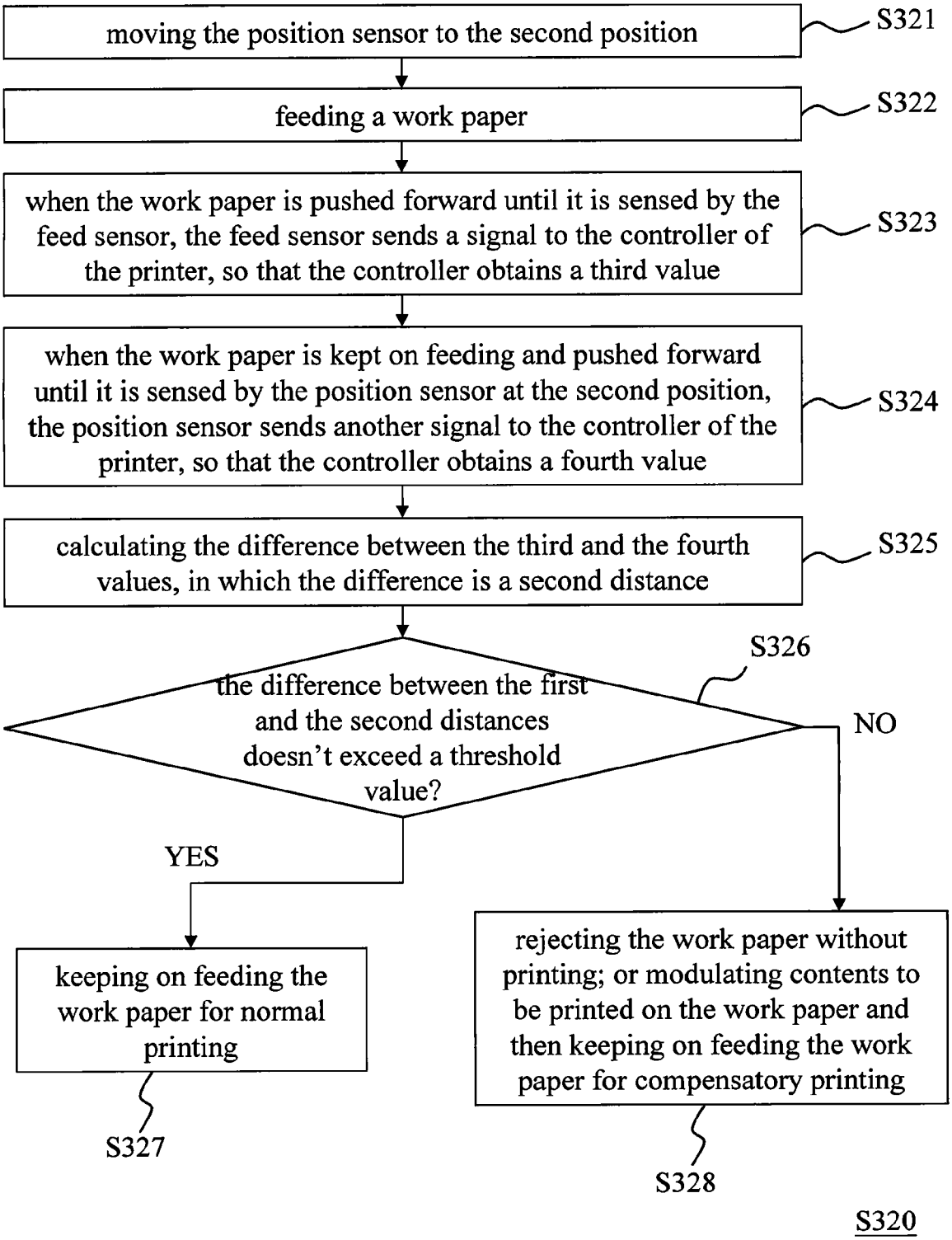

FIGS. 3A and 3B are a flowchart illustrating a method for sensing and correcting a skew paper in accordance with one embodiment of the present invention, in which the flowchart describes how to employ the position sensor and the feed sensor of the printer shown in FIG. 2 for determining whether the paper skew exceeds a threshold value or not. FIGS. 4A-4D are sketch diagrams illustrating the planner relative position relationship of a paper, a feed sensor and a position sensor of the printer shown in FIG. 2. Referring now to FIGS. 3A-3B and FIGS. 4A-4D, the method for sensing and correcting the paper skew in accordance with the present invention includes two stages: a first stage S310 shown in FIG. 3A; and a second stage S320 shown in FIG. 3B. The first stage S310 is performed for obtaining a first distance (such as ΔY1 in FIG. 4A) as a comparison standard, and then the second stage S320 is performed for feeding a paper, obtaining a second distance (such as ΔY2 in FIG. 4C, or ΔY2' in FIG. 4D) before printing, and determining whether the paper is kept on feeding to print according to the difference between the first distance and the second distance.

Figure 4A:
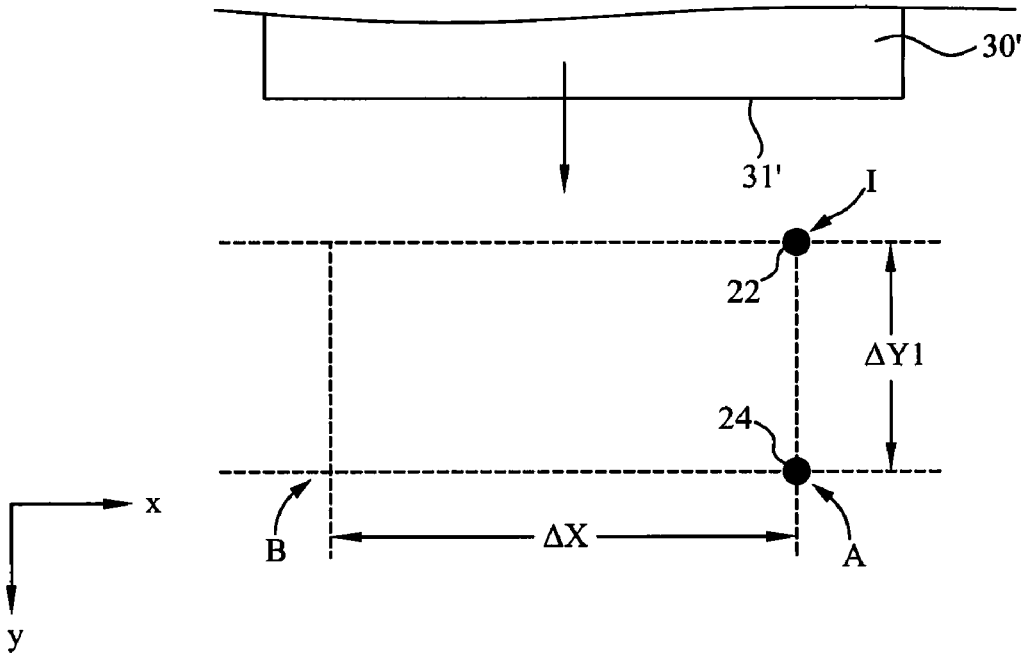
FIGS. 4A-4D are sketch diagrams illustrating the planner relative position relationship of a paper, a feed sensor and a position sensor of the printer shown in FIG. 2.

In one embodiment, the first stage S310 includes steps S311-S315. At the step S311, as shown in FIG. 4A, the position sensor 24 is moved to a first position A. The first position A is the intersection of a moving path of the position sensor 24 and a line, in which the feed sensor 22 is on the line, and the line is parallel to the direction of paper feeding (i.e. the direction of y). It is obvious that the moving path of the position sensor 24 is parallel to the direction of x because the position sensor 24 moves in the direction of x. At the step S312, a measure paper 30' is fed. The measure paper 30' is only used for obtaining the first distance ΔY1 as the comparison standard, and not used for printing, where ΔY1 is larger than zero. At the step S313, when the measure paper 30' is pushed forward until its head 31' is sensed by the feed sensor 22 at the start position I, the feed sensor 22 sends a signal to the controller of the printer 20, so that the controller obtains a first value from the driver of the motor. At the step S314, the measure paper 30' is kept on feeding and pushed forward until its head 31' is sensed by the position sensor 24 at the first position A, the position sensor 24 sends another signal to the controller of the printer 20, so that the controller obtains a second value from the driver of the motor. At the step S315, the controller calculates the difference between the first value and the second value, in which the difference is a first distance ΔY1. In other words, the first distance ΔY1 is the moving distance of the measure paper 30' fed, starting when the measure paper 30' is sensed by the feed sensor 22 at the start position I and ending when the measure paper 30' is sensed by the position sensor 24 at the first position A. Generally speaking, the first distance ΔY1 can be measured by the manufacturer and preset in the printer 20 before market, and may be reset by the steps S311-S315 by the user each time (such as change the ink cartridge every time) after market. Of course the first distance ΔY1 can be set by the steps S311-S315 by the user at the start, and then may be reset by the steps S311-S315 by the user each time.

Figure 4B:
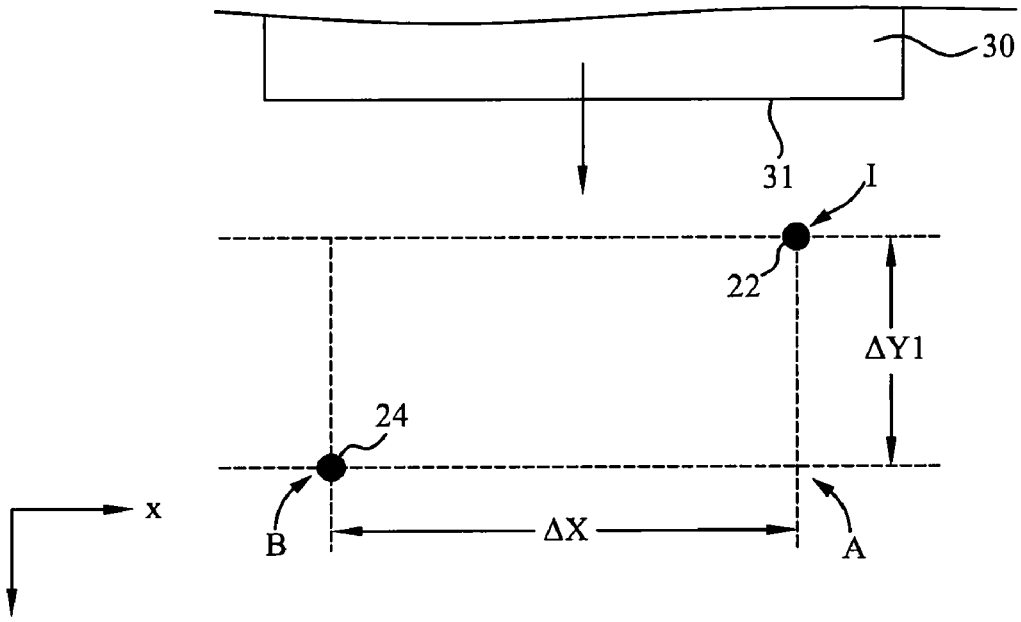
Figure 4C:
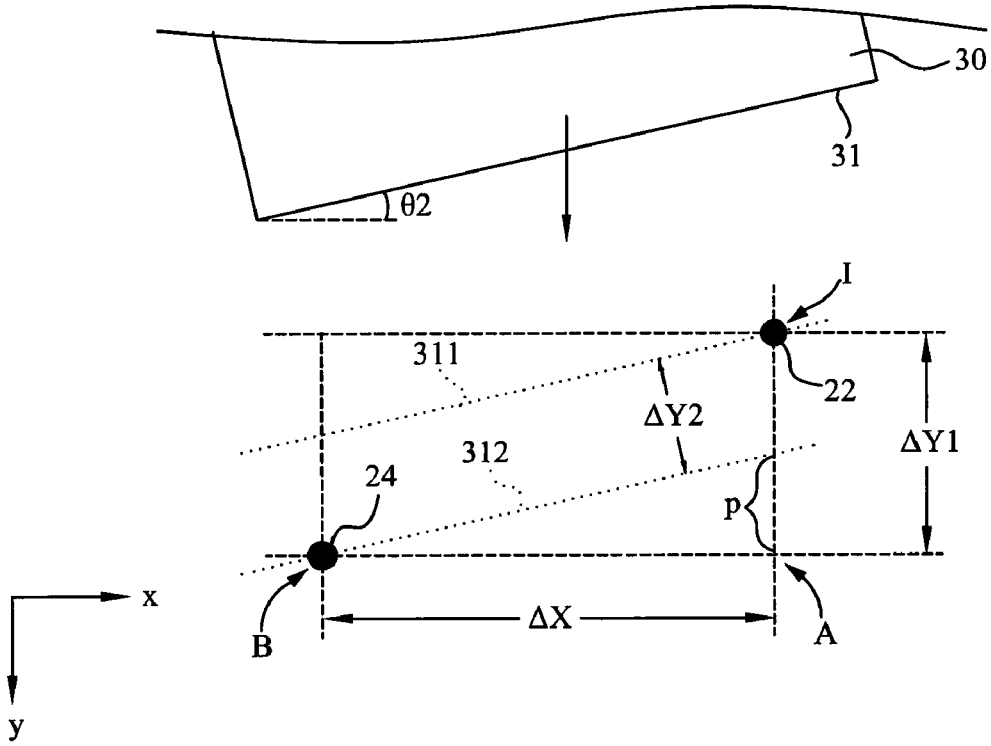
Figure 4D:
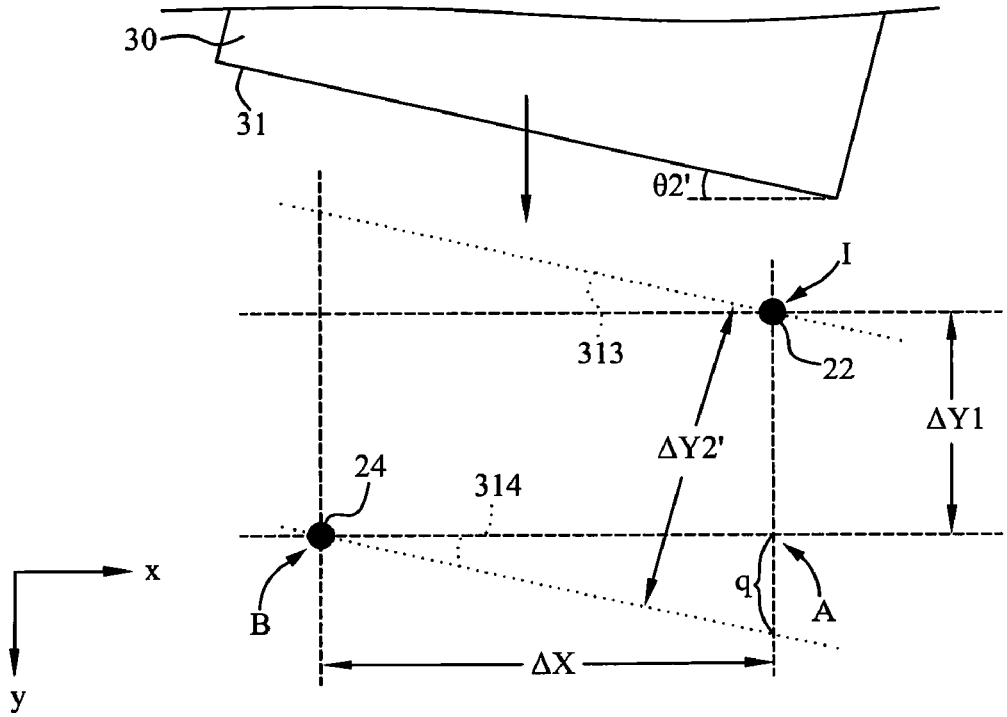

In one embodiment, the second stage S320 includes steps S321-S328. At the step S321, as shown in FIG. 4B, the position sensor 24 is moved to a second position B. The second position B and the first position A are different positions, for example, in the embodiment the second position B is located at distance ΔX from the first position A in the direction of x, where ΔX is larger than zero. The value of ΔX can be obtained by calculating the difference between the two values obtained early and late from the driver of the motor for moving the position sensor 24, in which the two values obtained early and late are corresponding to the first position A and the second position B, respectively. At the step S322, a work paper 30 is fed. At the step S323, when the work paper 30 is pushed forward until its head 31 is sensed by the feed sensor 22 at the start position I, the feed sensor 22 sends a signal to the controller of the printer 20, so that the controller obtains a third value from the driver of the motor. At the step S324, the work paper 30 is kept on feeding and pushed forward until its head 31 is sensed by the position sensor 24 at the second position B, the position sensor 24 sends another signal to the controller of the printer 20, so that the controller obtains a fourth value from the driver of the motor. At the step S325, the controller calculates the difference between the third value and the fourth value, in which the difference is a second distance ΔY2 or ΔY2'. In other words, the second distance ΔY2 or ΔY2' is the moving distance of the work paper 30 fed, starting when the work paper 30 is sensed by the feed sensor 22 at the start position I and ending when the work paper 30 is sensed by the position sensor 24 at the second position B. It is noted that the value of the second distance ΔY2 or ΔY2' may be smaller than the first distance ΔY1 (as shown in FIG. 4C), larger than the first distance ΔY1 (as shown in FIG. 4D) or equal to the first distance ΔY1 (as shown in FIG. 4C with θ2=0, or as shown in FIG. 4D with θ2'=0, each case represents that the work paper 30 is not skewed at all). At the step S326, it is determined that the difference between the first distance ΔY1 and the second distance ΔY2 or ΔY2' exceeds a threshold value or not. At the step S327, if the difference between the first distance ΔY1 and the second distance ΔY2 or ΔY2' doesn't exceed the threshold value, the work paper 30 is kept on feeding for printing; otherwise, at the step S328, if the difference between the first distance ΔY1 and the second distance ΔY2 or ΔY2' exceeds the threshold value, the work paper 30 is rejected without printing, or the contents to be printed on the work paper 30 is modulated in the software manner for compensating the paper skew and then the work paper 30 is kept on feeding for compensatory printing.

The following description will explain how to determine the skew type and the skew angle of work paper 30 for providing necessary parameters for compensating the paper skew. Referring now to FIG. 4C, we define that the skew type of the work paper 30 is "leading", and the skew angle is θ2. When the work paper 30 is pushed forward until it is sensed by the feed sensor 22, its head 31 is on the line 311, and the controller obtains the third value corresponding to the head 31 on the line 311. When the work paper 30 is kept on feeding and pushed forward until it is sensed by the position sensor 24, its head 31 is now on the line 312, and the controller obtains the fourth value corresponding to the head 31 on the line 312. Accordingly, the controller of the printer 20 calculates the difference between the third and the fourth values obtained early and late, in which the difference is the second distance ΔY2. From FIG. 4C, it is obvious that the second distance ΔY2 is smaller than the first distance ΔY1 when the skew type is "leading". In addition, according to the known ΔX, ΔY1 and ΔY2, it can be calculated that the skew angle θ2 is $\tan^{-1}$ [p/ΔX] in radian, where p is the solution of the equation $\tan(\theta 2)=p/\Delta X=[(\Delta Y1-p)^2-(\Delta Y2)^2]^{1/2}/\Delta Y2$.

Referring now to FIG. 4D, we define that the skew type of the work paper 30 is "lagging", and the skew angle is θ2'. When the work paper 30 is pushed forward until it is sensed by the feed sensor 22, its head 31 is on the line 313, and the controller obtains the third value corresponding to the head 31 on the line 313 (the third value of FIG. 4D and the third value of FIG. 4C may be the same or not). When the work paper 30 is kept on feeding and pushed forward until it is sensed by the position sensor 24, its head 31 is now on the line 314, and the controller obtains the fourth value corresponding to the head 31 on the line 314 (the fourth value of FIG. 4D and the fourth value of FIG. 4C may be the same or not). Accordingly, the controller of the printer 20 calculates the difference between the third and the fourth values obtained early and late, in which the difference is the second distance ΔY2'. From FIG. 4D, it is obvious that the second distance ΔY2' is larger than the first distance ΔY1 when the skew type is "lagging". In addition, according to the known ΔX, ΔY1 and ΔY2', it can be calculated that the skew angle θ2' is $\tan^{1}$ [q/ΔX] in radian, where q is the solution of the equation $\tan(\theta 2')=q/\Delta X=[(\Delta Y1+q)^2-(\Delta Y2')^2]^{1/2}/\Delta Y2'$.

In the embodiment as shown in FIG. 4A-4D, the start position I and the first position A are on one side of the second position B (for example, I and A are on right side of B). Therefore, if the difference between the second distance and the first distance (i.e. the second distance minus the first distance) is negative, such as ΔY2−ΔY1<0 shown in FIG. 4C, the skew type is "leading"; otherwise, if the difference between the second distance and the first distance is positive, such as ΔY2'−ΔY1>0 shown in FIG. 4D, the skew type is "lagging". In an alternative embodiment, compared with the embodiment as shown in FIG. 4A-4D, the start position I and the first position A are on the other side of the second position B (for example, compared with FIG. 4A-4D, I and A are changed to be on left side of B). Therefore, if the difference between the second distance and the first distance is negative, the skew type is "lagging"; otherwise, if the difference between the second distance and the first distance is positive, the skew type is "leading". Under the condition that both the feed sensor 22 and the position sensor can sense the work paper 30 (or its head 31), the accuracy of the method for sensing the paper skew in accordance with the present invention is higher while the value of ΔX is larger. It is better that the first position A and the second position B is designated to be on two side of the work paper 30 in order to enlarger the value of ΔX. In addition, if the method of the present invention doesn't consider the compensatory printing (i.e. doesn't determine the skew type and the skew angle), the method can determine whether the work paper is skewed or not according to the difference between the first distance ΔY1 and the second distance ΔY2 or ΔY2', and then determine that keeping on feeding the work paper for printing or rejecting the work paper without printing.

In summary, the present invention employs the existing feed and position sensors of the device (such as a printer, copier or scanner) having the paper feeding mechanism for sensing the paper skew, and further utilizes the sensing result for correcting the paper skew or directly rejecting the paper. It is because that the device having the paper feeding mechanism generally configures sensors (such as the feed sensor of the present invention) for sensing the paper feeding condition (such as paper jam or out-of-paper), and the print head or image sensor of the device generally configures a position sensor for positioning the print head or image sensor while it shuttlecocks to print or scan.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for correcting a paper skew adapted for a device having a paper feeding mechanism, wherein the device has a feed sensor which is fixed at a start position of paper feeding; and, a position sensor which moves in a direction perpendicular to a direction of paper feeding and passes through a first position and a second position, wherein the first position is the intersection of a moving path of the position sensor and a line, wherein the feed sensor is on the line, and the line is parallel to the direction of paper feeding, the method for correcting the paper skew comprising:

the device having a first distance which is a moving distance of a measure paper fed, starting when the measure paper is sensed by the feed sensor and ending when the measure paper is sensed by the position sensor at the first position;

moving the position sensor to the second position;

feeding a work paper into the device;

obtaining a second distance which is a moving distance of the work paper fed, starting when the work paper is sensed by the feed sensor and ending when the work paper is sensed by the position sensor at the second position; and keeping on feeding the work paper to be processed by the device if the difference between the first distance and the second distance doesn't exceed a threshold value, and modulating contents to be printed on or scanned from the work paper for compensating the paper skew and then keeping on feeding the work paper to be processed by the device if the difference between the first distance and the second distance exceeds the threshold value.

2. The method for correcting the paper skew according to claim 1, wherein obtaining the first distance comprises:

moving the position sensor to the first position;

feeding the measure paper into the device; and obtaining the first distance which is a moving distance of the measure paper fed, starting when the measure paper is sensed by the feed sensor and ending when the measure paper is sensed by the position sensor at the first position.

3. The method for correcting the paper skew according to claim 1, wherein the device is a printer, copier or scanner, and the position sensor is installed on a print head of the printer or copier, or installed on an image sensor of the scanner.

4. The method for correcting the paper skew according to claim 1, further comprising:

determining the skew type of the work paper according to the first distance being larger than, smaller than or equal to the second distance.

5. The method for correcting the paper skew according to claim 4, further comprising:

determining the skew angle of the work paper according to the first distance, the second distance and the distance between the first position and the second position.

6. The method for correcting the paper skew according to claim 4, when the start position and the first position are on one side of the second position, the skew type of the work paper is leading if the difference between the second distance minus the first distance is negative, the skew type of the work paper is lagging if the difference between the second distance minus the first distance is positive, and the work paper is not skewed if the difference between the second distance minus the first distance is zero.

7. The method for correcting the paper skew according to claim 6, when the start position and the first position are on the other side of the second position, the start position of paper feeding and the first position are on one side of the second position, the skew type of the work paper is lagging if the difference between the second distance minus the first distance is negative, the skew type of the work paper is leading if the difference between the second distance minus the first distance is positive, and the work paper is not skewed if the difference between the second distance minus the first distance is zero.

8. The method for correcting the paper skew according to claim 1, wherein the first position and the second position are on both side of the paper, respectively.

9. The method for correcting the paper skew according to claim 1, wherein the paper feeding mechanism employs a stepping motor for driving a roller to feed the paper; and a driver for controlling the stepping motor, wherein the moving distance of the measure or work paper fed is obtained from the driver.

10. The method for correcting the paper skew according to claim 1, wherein the paper feeding mechanism employs a DC motor cooperated with a rotary sensor or encoder for driving a roller to feed the paper; and a driver for controlling the DC motor and the rotary sensor or encoder, wherein the moving distance of the measure or work paper fed is obtained from the driver.

11. The method for correcting the paper skew according to claim 1, wherein the paper feeding mechanism employs a stepping motor for moving the position sensor; and a driver for controlling the stepping motor, wherein a moving distance of the position sensor is obtained from the driver.

12. The method for correcting the paper skew according to claim 1, wherein the paper feeding mechanism employs a DC motor cooperated with a rotary sensor or encoder for moving the position sensor; and a driver for controlling the DC motor and the rotary sensor or encoder, wherein a moving distance of the position sensor is obtained from the driver.

13. The method for correcting the paper skew according to claim 1, wherein the device is a printer, copier or scanner.

14. The method for correcting the paper skew according to claim 13, wherein the position sensor is installed on a print head of the printer or an image sensor of the scanner.

* * * * *